United States Patent [19]

Kanisawa et al.

[11] 4,288,535

[45] Sep. 8, 1981

[54] PROCESS FOR PREPARING SILVER HALIDE PHOTOGRAPHIC EMULSIONS

[75] Inventors: Hideo Kanisawa; Tamio Kitahata; Hideo Horie, all of Hino, Japan

[73] Assignee: Konishiroku Photo Industry Co., Ltd., Tokyo, Japan

[21] Appl. No.: 151,410

[22] Filed: May 19, 1980

[30] Foreign Application Priority Data

Jun. 16, 1979 [JP] Japan ..... 54/76215

[51] Int. Cl.[3] ..... G03C 1/02; G03C 1/28

[52] U.S. Cl. ..... 430/569; 430/264; 430/600; 430/603; 430/605; 430/608; 430/949; 430/963

[58] Field of Search ..... 430/605, 604, 603, 600, 430/608, 569, 949, 963, 264

[56] References Cited

U.S. PATENT DOCUMENTS

| | | | |
|---|---|---|---|
| 2,448,060 | 8/1948 | Smith et al. | 430/605 |
| 2,717,833 | 9/1955 | Wark | 430/605 |
| 3,384,490 | 5/1968 | Rees | 430/605 |
| 3,901,711 | 8/1975 | Iwaosa et al. | 430/608 |
| 3,979,213 | 9/1976 | Gilman et al. | 430/605 |

FOREIGN PATENT DOCUMENTS

| | | |
|---|---|---|
| 43-4935 | of 1968 | Japan . |
| 45-32738 | of 1970 | Japan . |
| 49-33781 | of 1974 | Japan . |

*Primary Examiner*—J. Travis Brown

*Attorney, Agent, or Firm*—Bierman & Bierman

[57] ABSTRACT

A process for preparing silver halide emulsions having high sensitivity and contrast by adding water-soluble iridium compounds during precipitation or physical ripening and adding water-soluble iodide compounds and sulfer sensitizers during chemical ripening.

8 Claims, No Drawings

PROCESS FOR PREPARING SILVER HALIDE PHOTOGRAPHIC EMULSIONS

This invention relates to a process for preparing silver halide photographic emulsions showing high sensitivity and contrast in case of the high illuminance short time exposure, i.e. flash exposure, and to the process for preparing the photographic emulsions improved particularly in its high temperature treatment characteristics.

In recent years, systems regarding transmission, reproduction, recording or replication of images have made rapid progress. Keeping the space of the progress of the systems, processes or apparatuses for quickly visualizing a variety of image signals have actively been developed.

To cite one example of the generally known systems of the kind, there may be mentioned, for example, image reproduction and recording processes in facsimile which is a system to transmit the image information to a remote place; recording for output of computer; reproduction, recording and printing of hollowgraphic images; or high speed photocomposing system; high speed halftone color separation system or halftone dot generating system in the fields related to printing and replication techniques.

Apparatuses used in these image information transmitting and recording systems are equipped with instruments for light source composed of high illuminance light source or high speed shutter, and as the light source there is used a xenon flash lamp, xenon lamp, high pressure mercury lamp, laser beam or fluorescent flying spot of cathode-ray tube.

In the case of effecting photoelectric conversion of the image using any of the above-mentioned light sources, it is necessary to accurately control and change the quantity of light to be received by the photosensitive element surface in answer to changes in strength of signal current of the image as well as to on-off of the signal current.

Because of very high illuminance and very short time exposure (for example $10^{-5}$ to $10^{-7}$ second) involved, the flash exposure brings about a phenomenon called "reciprocity law failure" known as the characteristic of photographic emulsion, thereby deteriorating the photographic emulsion subjected to flash exposure in its sensitivity, contrast and density.

The thus observed phenomenon may be obviated or lessened by making improvements on the process for preparing photographic emulsions.

It is already well known, for example, from Japanese Patent Publications Nos. 4935/1968, 32738/1970 and 33781/1974, that photographic emulsions can effectively improved in their sensitivity and contrast by incorporating into silver halide emulsions a salt of iridium, either singly or in combination with other kind of metal, for example, rhodium or gold, when said emulsions are intended to be subjected to exposure involving high illuminance and short exposure time. In accordance with the processes referred to above, however, no sufficient effect can be expected yet.

It is a primary object of the present invention to provide a novel process for preparing silver halide photographic emulsions having improved high sensitivity and high contrast even when subjected to flash exposure with high illuminance and short exposure time.

Further, a secondary object of the present invention is to provide a process for preparing silver halide photographic emulsions involving no formation of fog when subjected particularly to high temperature quick treatment with non-lith developers.

In this connection, conventional silver halide photographic materials for flash exposure have heretofore been developed at room temperature in the vicinity of 20° C. with D-11 Developer (Eastman Kodak Co.), D-85 Lith Type Developer (Eastman Kodak Co.) or the like, and the processing time required therefor was 2 to 3 minutes.

While the so-caleed lith type developer contains only a hydroquinon as a developing agent and a very low or no free sulfite ion, the "non-lith developer" means a developer containing at least two sorts of developing agents and greater than 0.2 mol of sulfite ion in a developer per 1 liter.

Recently, however, keeping the pace with development of quick processing techniques of photosensitive materials for flash exposure, the high temperature quick treatment technique (processing temperature of 30° to 45° C., processing time of 20 to 30 seconds) relying on the use of the so-called non-lith type developer has been introduced and made fit for practical use without using the lith type developer, the quality control of which is difficult. Under such circumstance, it has become important to develop the technique for preparing silver halide photographic emulsions for flash exposure which have photographic efficiency meeting adaptability to the high temperature quick treatment.

As a result of researches conducted by the present inventors on the above-mentioned subject, they have eventually found that the objects of the present invention mentioned previously can be attained by virtue of the preparation of photographic emulsions, wherein $10^{-7}$ to $10^{-4}$ mole, based on mole of silver halide, of a water-soluble iridium salt is added at the stage of precipitation of silver halide grains or physical ripening thereof, and further $10^{-4}$ to $10^{-2}$ mole, based on mole of silver halide, of a water-soluble iodide and a sulfur sensitizer is added into the emulsion at the stage of chemical ripening thereof.

Any noble metal known as a noble metal sensitizer (such as compound of gold, iridium, rhodium) can not be added to the emulsion of the present invention after the physical ripening, namely the emulsion of the present invention is not sensitized by a noble metal sensitizer.

Usable as water-soluble iridium compounds in the process of the present invention are various salts of iridium, typical examples of which are iridium chloride ($IrCl_3$ and $IrCl_4$), potassium iridium chloride, ammonium hexachloroiridate and the like. It may be as well to incorporate these compounds, preferably in the form of aqueous solution, into silver halide emulsions at the time of forming silver halide particles or at the stage of physical ripening, particularly desirably at the time of silver halide particle formation.

The optimum amount of the iridium compound to be incorporated may vary depending on the time at which said compound is incorporated, for instance, when the compound is incorporated into the emulsion at the time of silver halide particle formation, the amount thereof smaller than that used in the later stage will suffice. Furthermore, a water-soluble rhodium salt in an amount equal to or less than that of the iridium salt may also be used in combination with said iridium salt with the view of promoting the hardening of contrast.

Usable as water-soluble iodides in the process of the present invention are those various in kind, typical concrete examples of which are such alkali metal salts, for example, as sodium iodide and potassium iodide, such alkaline earth metal salts, for example, as magnesium iodide and calcium iodide, and ammonium iodide, etc. These compounds are preferably incorporated in the form of aqueous solution into the emulsions at the stage of chemical ripening, particularly preferably at the beginning of chemical ripening step.

The amount of the water-soluble iodide used in the process of the present invention is $10^{-4}$ to $10^{-2}$ mole, preferably $10^{-4}$ to $10^{-3}$ mole per mole of silver halide. If the amount of the iodide incorporated is less than $10^{-4}$ mole, no practical effect of the addition thereof is obtained and, on the other hand, when said amount is greater than $10^{-2}$ mole, desensitization is brought about, whereby no objects of the present invention can be accomplished.

Furthermore, the chemical sensitizing technique adaptable in the process of the present invention is limited to that which relies on the use of sulfer sensitizers. Usable sulfur sensitizers are common sulfur compounds such as sodium thiosulfate, ammonium thiosulfate, etc.

The amount of the sulfur sensitizer to be incorporated is $5\times10^{-6}$ to $5\times10^{-4}$ mole, preferably $1\times10^{-5}$ to $1\times10^{-4}$ mole per mole of silver halide, though said amount may vary depending on the composition of emulsion, shape and size of silver halide particles or the like factors.

The emulsion may be optically sensitized by means of a sensitizing dye.

The emulsion used in the process of the present invention may contain silver chloride, silver chlorobromide, silver chloroiodobromide, silver bromide or silver iodobromide. In order to obtain high contrast, however, preferably are silver halide emulsions containing silver chloride as the major portion of silver halide, particularly such emulsions as containing silver chloride of 50 mole% or more. These emulsions may be prepared by emulsification according to methods known per se. The emulsions according to the present invention may also be incorporated with common photographic additives, for example, stabilizers, film hardeners and the like agents.

As processing solutions according to the present invention, there may be used even a lith developer, including of course developers of other types. However, it is most preferable to use developers for use in high temperature quick treatment, for example, particularly anlith type developers such as CDM-611 (produced by Konishiroku Photo Industry Co., Ltd.), 55 Developer (produced by Eastman Kodak Co.), GRP-7 Developer (produced by Gevaert-AGFA) and LD-835 Developer (produced by Fuji Photo, Film Co.).

The present invention is illustrated below more concretely with reference to examples, but it should be construed that the scope of the invention is not limited thereto.

EXAMPLE 1

An emulsion (comparative sample 1) was prepared according to the following recipe.

| | |
|---|---|
| Liquid A | |
| Water | 300 cc |
| Gelatin | 10 g |

-continued

| | |
|---|---|
| Liquid B | |
| Water | 300 cc |
| Silver nitrate | 60 g |
| Liquid C | |
| Water | 300 cc |
| Potassium bromide | 11 g |
| Sodium chloride | 18 g |
| Dipotassium iridium pentachloride (0.01% soln.) | 3 cc |

To the liquid A while maintaining at 60° C. were simultaneously added the liquid B and C over a period of 3 minutes. Thereafter, the resulting mixture was kept at 60° C., for 5 minutes, followed by cooling and desalting, and adjusted to 300 cc with the addition of 15 g of gelatin.

The thus prepared emulsion, after adjustment of silver potential with sodium chloride, was ripened for 60 minutes by adding an aqueous solution containing 58 mg of potassium iodide, heating up to 50° C. and further adding an aqueous solution containing 1.4 mg of chloroaurate and 3.5 mg of sodium thiosulfate. After completion of the ripening, the emulsion was optically sensitized with a dye of the following general formula.

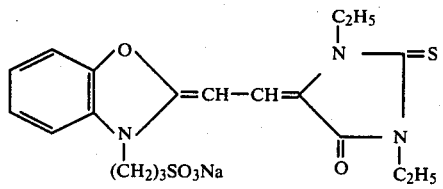

The thus sensitized emulsion was incorporated with 4-hydroxy-1,3,3a,7-tetrazaindene as a stabilizer, mucochloric acid as a film hardener and saponin as an extender, and then coated on a polyethylene terephthalate film base and dried to prepare a comparative sample (1).

Subsequently, a sample (2) of the present invention was prepared in the same manner as mentioned above, except that in place of the aqueous solution containing chloroaurate and sodium thiosulfate, an aqueous solution of 10 mg of sodium thiosulfate (corresponding to $4\times10^{-5}$ mole per mole of silver halide) was used.

Further, a sample (3) of the present invention was prepared in the same manner as in the case of the comparative sample (1), except that in place of the aqueous solution containing chloroaurate and sodium thiosulfate, an aqueous solution of 25 mg of sodium thiosulfate (corresponding to $1\times10^{-4}$ mole per mole of silver halide) was used.

The samples thus prepared were individually exposed through an optical wedge to light from a xenon flash discharge tube (exposure time: $10^{-5}$ second) and then developed at 32° C. for 30 seconds with CDM-611 developer (produced and sold by Konishiroku Photo Industry Co. Ltd.), followed by fixing, water-washing and drying in the usual way. The thus processed samples were measured in photographic characteristics to obtain the results as shown in Table 1 wherein the speed was represented by a relative value as measured by assuming as 100 the speed of the comparative sample (1).

TABLE 1

| | Relative speed | Gamma | Fog |
|---|---|---|---|
| Comparative sample (1) | 100 | 3.5 | 0.15 |
| Present sample (2) | 125 | 4.6 | 0.04 |
| Present sample (3) | 133 | 4.5 | 0.05 |

From the above table, it is understood that in case of the high temperature quick treatment, the samples (2) and (3) according to the present invention (each incorporated with a sulfur sensitizer only) showed excellent values as measured with respect the speed, contrast and fog all together, as compared with the comparative sample (1) (incorporated with a gold salt and a sulfur sensitizer).

EXAMPLE 2

An emulsion was prepared in the same recipe as in Example 1, except that 0.05 cc of a 0.01% saline solution of rodium chloride was added further to the liquid (C).

This emulsion, after adjustment of silver potential with sodium chloride, was ripened for 65 minutes by adding an aqueous solution containing 290 mg of sodium iodide, heating up to 50° C., and further adding an aqueous solution containing 1.0 mg of chloroaurate and 4.5 mg of sodium thiosulfate. After completion of the ripening, the emulsion was optically sensitized with a dye of the following general formula.

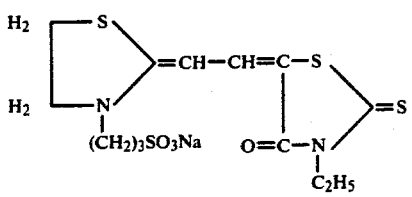

The thus sensitized emulsion was incorporated with 4-hydroxy-1,3,3a,7-tetrazaindene as a stabilizer, mucochloric acid as a film hardener, and saponin as an extender, and then coated on a polyethylene terephthalate film base and dried to prepare a comparative sample (1).

Subsequently, a sample (2) of the present invention was prepared in the same manner as mentioned above, except that in place of the aqueous solution containing chloroaurate and sodium thiosulfate, an aqueous solution of 10 mg of sodium thiosulfate (corresponding to $4\times10^{-5}$ mole per mole of silver halide) was added.

Further, a sample (3) of the present invention was prepared in the same manner as in the case of the comparative sample (1), except that in place of the aqueous solution containing chloroaurate and sodium thiosulfate, an aqueous solution of 25 mg of sodium thiosulfate (corresponding to $1\times10^{-4}$ mole per mole of silver halide) was added.

The samples thus prepared were individually exposed to light of 514.5 nm for $10^{-5}$ second using an argon laser oscillating apparatus (JLG-A 4 Type, manufactured by Nippon Densi K.K.) and then developed at 40° C. for 25 seconds with 55 developer (produced and sold by Eastman Kodak Co.), followed by fixing, water-washing and drying in the usual way. The thus processed samples were measured in photographic characteristics to obtain the results as shown in Table 2 wherein the speed was represented by a relative value as measured by assuming as 100 the speed of the comparative sample (1).

TABLE 2

| | Relative speed | Gamma | Fog |
|---|---|---|---|
| Comparative sample (1) | 100 | 5.0 | 0.12 |
| Present sample (2) | 125 | 6.2 | 0.03 |
| Present sample (3) | 133 | 6.0 | 0.06 |

It is understood from the above table that in case of the high temperature quick treatment, the samples (2) and (3) according to the present invention (each incorporated with a sulfur sensitizer only) showed excellent values as measured with respect to speed, contrast and fog all together, as compared with the comparative sample (1) (incorporated with a gold salt and a sulfur sensitizer), and in addition thereto that the incorporation into the emulsion of the rhodium salt contributed particularly to improvement of contrast.

What we claim is:

1. A process for preparing a silver halide photographic emulsion which process comprises adding a water-soluble iridium compound in an amount of $10^{-7}$ to $10^{-4}$ mole per mole of the silver halide at the stage of precipitation of silver halide grains or physical ripening thereof, and adding a water-soluble iodide in an amount of $10^{-4}$ to $10^{-2}$ mole per mole of the silver halide and a sulfur sensitizer at the stage of chemical ripening thereof.

2. A process according to claim 1, wherein the amount of the sulfur sensitizer is $5\times10^{-6}$ mole to $5\times10^{-4}$ mole per mole of the silver halide.

3. A process according to claim 1, wherein the sulfur sensitizer is a water-soluble thiosulfate.

4. A process according to claim 1, wherein a water-soluble rhodate in an amount equal to or less than that of the iridium compound is added at the stage of precipitation.

5. A process according to claim 1, wherein the water-soluble iridium compound is iridium chloride, potassium iridium chloride or ammonium hexachloroiridate.

6. A process according to claim 1, wherein the water-soluble iodide is sodium iodide, potassium iodide, magnesium iodide, calcium iodide or ammonium iodide.

7. A process according to claim 4, wherein the water-soluble rhodium compound is rhodium chloride.

8. A process according to claim 1, wherein the silver halide contains at least 50 mol% of silver chloride.

* * * * *